United States Patent [19]

Yamawaki et al.

[11] Patent Number: 4,673,905

[45] Date of Patent: Jun. 16, 1987

[54] CORRUGATED ELLIPTICAL WAVEGUIDE OR HORN

[75] Inventors: Seiichi Yamawaki; Tomoki Obuchi; Noboru Toyama; Kazuyoshi Shogen, all of Tokyo, Japan

[73] Assignee: NEC Corporation, Japan

[21] Appl. No.: 767,495

[22] Filed: Aug. 20, 1985

[30] Foreign Application Priority Data

Aug. 22, 1984 [JP] Japan ..... 59-174666

[51] Int. Cl.[4] ..... H01P 3/127

[52] U.S. Cl. ..... 333/239; 343/786

[58] Field of Search ..... 333/21 R, 239, 242; 343/786

[56] References Cited

U.S. PATENT DOCUMENTS 3,772,619 11/1973 Clarricoats ..... 333/242
4,048,592 9/1977 Drabowitch ..... 333/239 X
4,356,495 10/1982 Mörz ..... 343/786
4,472,721 9/1984 Mörz et al. ..... 343/786

*Primary Examiner*—Paul Gensler
*Attorney, Agent, or Firm*—Ostrolenk, Faber, Gerb & Soffen

[57] ABSTRACT

A corrugated elliptical waveguide medium comprises a corrugated hybrid mode excitation member having an elliptical transverse cross-section for propagating electromagnetic energy therethrough. The excitation member is provided with longitudinally spaced apart parallel corrugations with the teeth of the corrugations defining an inner ellipse and the grooves of the corrugations defining an outer ellipse. The depths of the corrugation grooves on the major and minor axes of the ellipsis are dimensioned such that the tangential electric and magnetic field components of the energy in a circumferential direction are zero on the inner ellipse.

2 Claims, 8 Drawing Figures

X
Y
Z
O
1
2
4
5
3a
3b
1a
W
P
bo
b1
a1
ao
ξo
ξ1

(eHE11)

(oHE11)

CORRUGATED ELLIPTICAL WAVEGUIDE OR HORN

BACKGROUND OF THE INVENTION

The present invention relates generally to corrugated elliptical waveguides or horns, and specifically to the determination of the depth of corrugation grooves of the waveguides or horns.

No definite design methods have hitherto been available to determine the depth of corrugation grooves of a corrugated elliptical waveguide or horn to excite a balanced hybrid mode, and the depth determination was based generally on the concept that a balanced hybrid mode exists when the corrugation grooves have a depth in the range between $\frac{1}{4}$ to $\frac{1}{2}$ of a wavelength in the free space. One disadvantage of this prior method is that the balanced hybrid mode is not perfect and this imperfection caused even the most perfectly adjusted waveguide or horn to generate cross polarizations by as much as −30 dB with respect to the main polarization. As a result, the prior art waveguide or horn when mounted on a broadcasting satellite as the primary radiator of a reflector antenna has experienced difficulties in meeting the cross polarization limits set by the World Administrative Radio Conference on Broadcasting Satellites 1979 (known as WARC-BS '79). The depth determination by experiments will involve solving an infinite number of possible combinations of odd modes (excitations on the major axis of ellipse) and even modes (excitations on the minor axis of the ellipse).

SUMMARY OF THE INVENTION

Accordingly, an object of the present invention is to provide a corrugated elliptical waveguide medium having a perfectly balanced hybrid excitation mode.

The corrugated elliptical waveguide medium of the present invention comprises a corrugated hybrid mode excitation member having an elliptical transverse cross section for propagation of electromagnetic energy therethrough. The excitation member is formed with longitudinally spaced parallel corrugations with teeth of the corrugations defining an inner ellipse and grooves of the corrugations defining an outer ellipse. The depths of the corrugation grooves are dimensioned such that the tangential electric and magnetic field components of the electromagnetic energy in said medium in a circumferential direction are zero on the inner ellipse.

BRIEF DESCRIPTION OF THE DRAWINGS

The present invention will be described in further detail with reference to the accompanying drawings, in which.

DETAILED DESCRIPTION

Figures 1, 1A, 2:
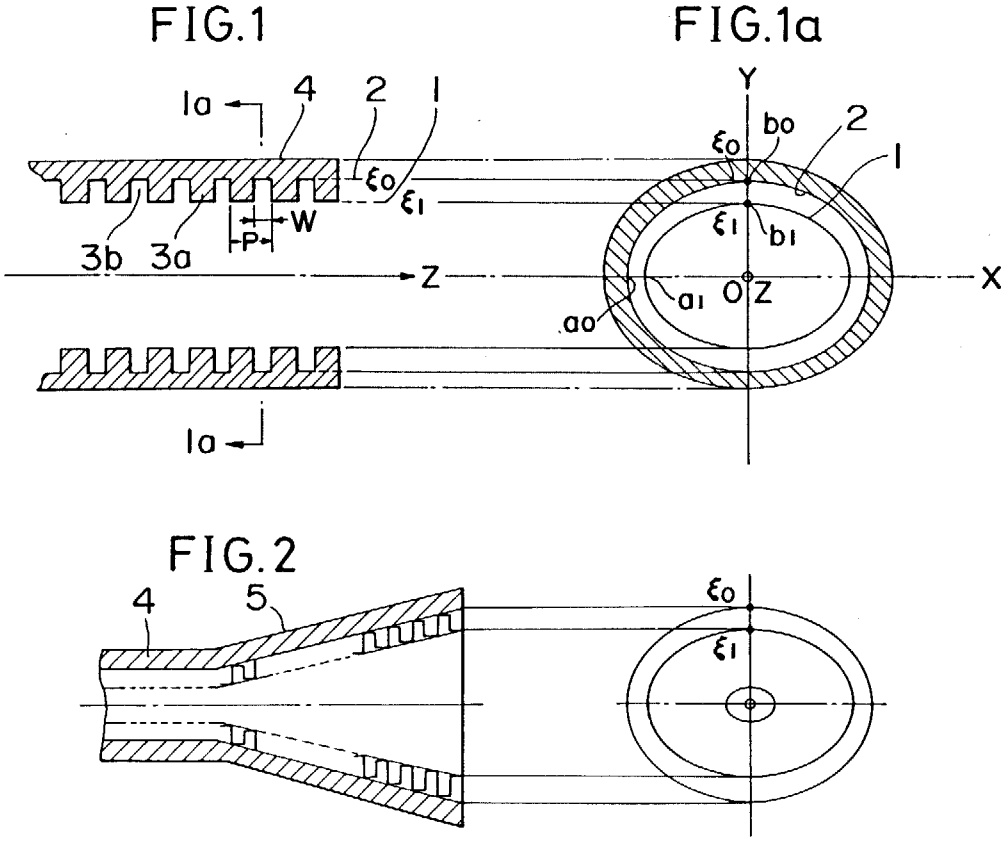
FIG. 1 is an illustration of a longitudinal cross-section of a corrugated elliptical waveguide and FIG. 1*a* is a cross-sectional view taken along the line 1*a* of FIG. 1.
FIG. 2 is a longitudinal cross-sectional view of a corrugated elliptical horn.
Figure 3A:
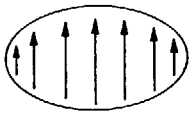
FIGS. 3*a* and 3*b* are illustrations of excitation modes.
Figure 3B:
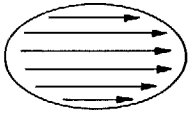

FIG. 1 is an illustration of the longitudinal cross-section of a corrugated elliptical waveguide comprising a balanced hybrid mode excitation member 4 with an elliptical cross section of constant size over its length. Waveguide member 4 is formed with longitudinally spaced, parallel corrugation teeth 3*a* and corrugation grooves 3*b*. Grooves 3*b* have a width "w" and are arranged with a pitch "p". An inner ellipse 1 described by the inner circumference of the corrugation teeth 3*a* defines an inner boundary with the free space and an outer ellipse 2 described by the outer circumference of the corrugation teeth, or bottom of the corrugation grooves 3*b*, defines an outer boundary with the free space. The longitudinal cross-sectional view of a corrugated elliptical horn is shown at FIG. 2. This elliptical horn comprises the hybrid mode excitation member 4 and a corrugated elliptical transition member 5 connected thereto. The transition member 5 has a cross section increasing linearly as a function of distance from the hybrid mode excitation member 4, the corrugations of the transition member 5 being identical to the corrugations of the excitation member 4. FIGS. 3*a* and 3*b* are illustrations of the balanced even and odd hybrid modes, respectively. In these figures, the arrows indicate the directions of electric lines of force, the subscripts "e" and "o" of the modes $eHE_{11}$ and $oHE_{11}$ indicates even and odd, respectively.

Figure 4:
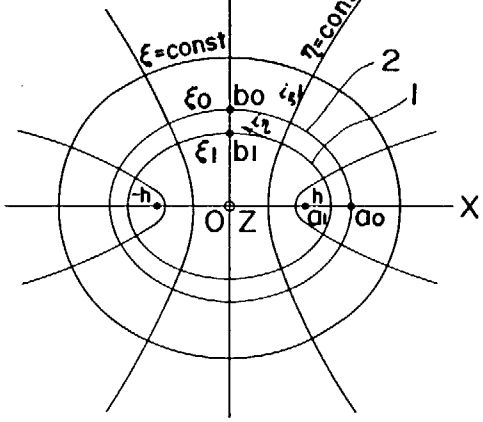
FIG. 4 is an illustration of an ellipsoidal representation of a transverse cross-section of the excitation member.

FIG. 4 is an illustration of a transverse cross-section of a corrugated elliptical waveguide in ellipsoidal coordinates ($\xi,\eta$, z) which relate to Cartesian coordinates (x, y, z) as follows:

$$\left.\begin{aligned} x &= h \cosh \xi \cos \eta \\ y &= h \sinh \xi \sin \eta \\ z &= z \end{aligned}\right\} \quad (1)$$

where, h is a constant equal to $\frac{1}{2}$ of the spacing between the confocal points of the elliptical cross section. The major axes $a_1$, $a_0$ and the minor axes $b_1$, $b_0$ on the ellipsis 1 and 2 are represented as follows:

$$\left.\begin{aligned} a_1 &= h \cosh \xi_1 \\ a_0 &= h \cosh \xi_0 \\ b_1 &= h \sinh \xi_1 \\ b_0 &= h \sinh \xi_0 \end{aligned}\right\} \quad (2)$$

If the eccentricities of the ellipsis 1 and 2 are denoted by $e_1$ and $e_0$ respectively, the following relations hold:

$$\left.\begin{aligned} e_1 &= h/a_1 \\ e_0 &= h/a_0 \end{aligned}\right\} \quad (3)$$

Figure 5:
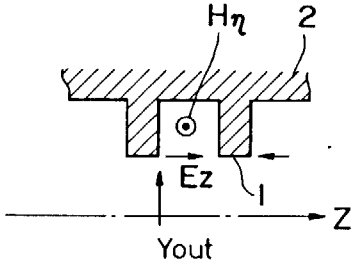
FIG. 5 is an enlarged cross-sectional view of corrugations.

FIG. 5 shows the relationship between electric field component Ez in the direction z and the magnetic field component $H_\eta$ in the circumferential direction of corrugation grooves 3*b*. Yout represents the admittance on the ellipse 1.

In order to satisfy the boundary condition, it is necessary that the tangent components $E_z$, $E_\eta$ and $H_\eta$ of the electromagnetic field within the corrugated waveguide 4 be continuous on the ellipse 1 where the relation $\xi=\xi_1$ holds.

With the corrugation groove width w being smaller than half wavelength, the TE mode, which is able to exist in an elliptical waveguide, is unable to exist in the corrugation grooves 3b where the relation $\xi_1<\xi<\xi_0$ holds. As a result, in order for a blanced hybrid mode to exist in the waveguide ($\xi<\xi_1$), it is necessary that the condition Yout $=H_{\eta/Ez}=0$ be established both with respect to even and odd modes on the inner boundary where $\xi=\xi_1$ and continuous with the electromagnetic field generated in the waveguide 4. Because $Ez\neq 0$, $H_\eta$ must be equal to 0. Since the TE mode is unable to exist in the corrugation grooves 3b as mentioned above, the condition $E_\eta=0$ holds on the inner boundary. Using Mathieu functions, the solution of Maxwell's equations at the boundary $\xi=\xi_1$ yields the following equations (refer to Maxwell's equations: Jansen, J. K. M and Jeuken, M. E. J.: "Circularly polarized horn antenna with an asymmetrical pattern" presented at the Fifth Colloquium on Microwave Communication, Budapest, ET-179 to ET-188, June 1974. Mathieu function: "Tables relating to Mathieu functions; characteristic, values, coefficients, and joining factors", Applied Mathematics Series 59, 1967 issued by U.S. Department of Commerce National Bureau of Standards): for even modes, $$\frac{J'_{op}(\xi_1, q^1)}{N'_{op}(\xi_1, q^1)} = \frac{J_{op}(\xi_0, q^1)}{N_{op}(\xi_0, q^1)} \quad (4)$$

for odd modes, $$\frac{J'_{ep}(\xi_1, q^1)}{N'_{ep}(\xi_1, q^1)} = \frac{J_{ep}(\xi_0, q^1)}{N_{ep}(\xi_0, q^1)} \quad (5)$$

where, p = the order of hybrid mode, this being unity for practical applications;

$q^1=(kh)^2/4$;

$k=2\pi/\lambda$;

$\lambda$ = wavelength;

$J_{op}$ = odd mode, primary modified Mathieu function;

$J'_{op}$ = first derivative of the odd mode, primary modified Mathieu function;

$N_{op}$ = odd mode, secondary modified Mathieu function;

$N'_{op}$ = first derivative of the odd mode, secondary modified Mathieu function;

$J_{ep}$ = even mode, primary modified Mathieu function;

$J'_{ep}$ = first derivative of the even mode, primary modified Mathieu function;

$N_{ep}$ = even mode, secondary modified Mathieu function; and $N'_{ep}$ = first derivative of the even mode, secondary modified Mathieu function.

$\xi_1$, $\xi_0$ and $q^1$ are obtained from Equations 4 and 5, and the depths $a_0$-$a_1$ and $b_0$-$b_1$ on the major and minor axes of the corrugation grooves 3b are derived from Equations 1, 2 and 3 using the thus obtained $\xi_1$, $\xi_0$ and $q^1$.

Figure 6:
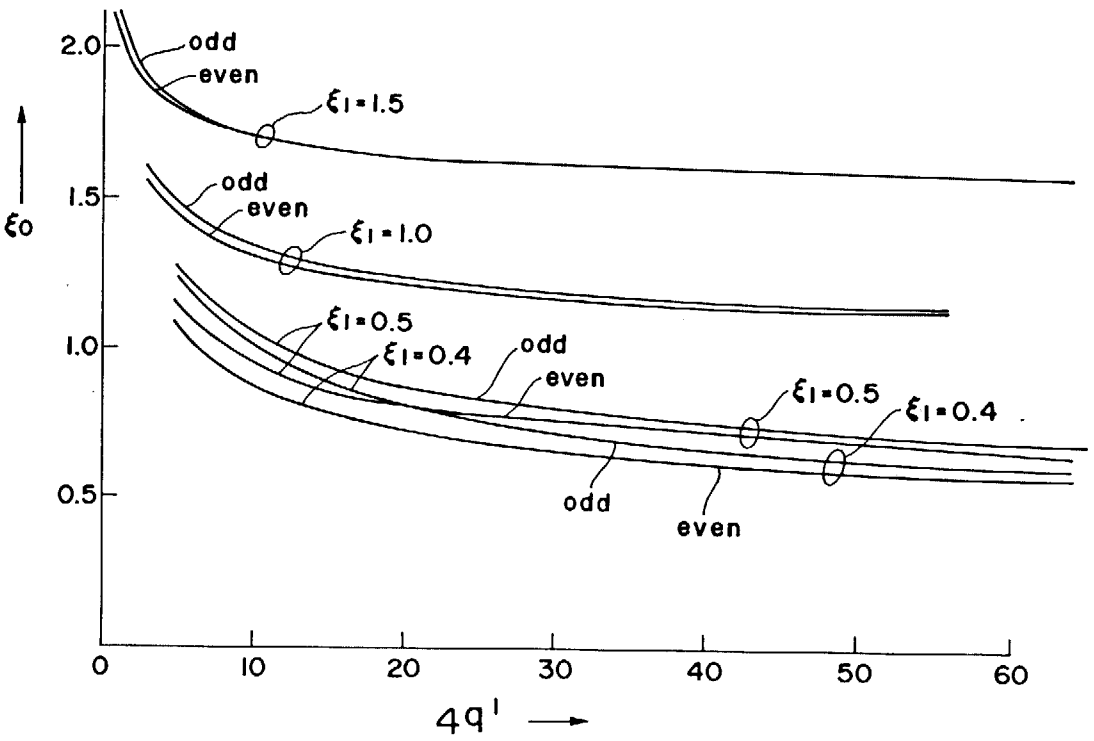
FIG. 6 is a graphic illustration useful for the determination of the depth of corrugation grooves.

The corrugated elliptical waveguide or horn can be constructed using a graphic illustration of FIG. 6. While it may be impossible to obtain perfect agreement between Equations 4 and 5 as the eccentricity increases as seen from FIG. 6, it is possible to design a corrugated elliptical waveguide or horn having a substantially perfectly balanced hybrid mode by the use of average values of the results of the equations.

Table below shows depths of corrugation grooves derived from Equations 4 and 5 for corrugated elliptical waveguides having a frequency of 12 GHz (wavelength = 25 mm), a pitch (P) of 4.86 mm and a corrugation groove width (w) of 3.46 mm.

TABLE

| DIMENSIONS (mm) | $a_1$ | $b_1$ | $a_0$ | $b_0$ | $a_0$-$a_1$ | $b_0$-$b_1$ |
|---|---|---|---|---|---|---|
| Example 1 | 19.4 | 14.8 | 25.2 | 21.9 | 5.8 | 7.1 |
| Example 2 | 43.4 | 33.1 | 48.9 | 40.0 | 5.5 | 6.9 |

If the corrugated elliptic horn of the present invention is mounted on a parabolic reflector antenna having an elliptic aperture, the antenna will operate at high efficiency with a considerably small amount of cross polarizations as compared with prior art antennas (an analysis shows that the cross polarization is approximately 50 dB lower than the main polarization). Therefore, if a corrugated elliptic horn is mounted on an elliptic reflector antenna of a broadcasting satellite or used as a primary radiator of a radar antenna, particularly used in circularly polarized excitation, the antenna's aperture efficiency can be improved to as much as 80% with an improved sidelobe characteristic.

The foregoing description shows only a preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. A waveguide medium comprising a corrugated hybrid mode excitation member having an elliptical transverse cross section for propagation of electromagnetic energy therethrough, said member being provided with longitudinally spaced parallel corrugations with teeth of the corrugations defining an inner ellipse and grooves of the corrugations defining an outer ellipse, wherein the depths of the corrugation grooves are given by ($a_0-a_1$) on major axes $a_0$ and $a_1$ of said inner and outer ellipses and ($b_0-b_1$) on minor axes $b_0$ and $b_1$ of said inner and outer ellipses, and wherein, in ellipsoidal coordinates ($\xi,\eta$, Z);

$a_1=h\cosh\xi_1$ $a_0=h\cosh\xi_0$ $b_1=h\sinh\xi_1$ $b_0=h\sinh\xi_0$ where h is a constant equal to ½ of the spacing between confocal points of an elliptical cross section of said excitation member, and for an even mode $\xi_1$ and $\xi_0$ satisfy the following:

$$\frac{J'_{op}(\xi_1, q^1)}{N'_{op}(\xi_1, q^1)} = \frac{J_{op}(\xi_0, q^1)}{N_{op}(\xi_0, q^1)}$$

and for an odd mode $\xi_1$ and $\xi_0$ satisfy the following:

$$\frac{J'_{ep}(\xi_1, q^1)}{N'_{ep}(\xi_1, q^1)} = \frac{J_{ep}(\tau_0, q^1)}{N_{ep}(\xi_0, q^1)}$$

where $q^1$ = p = the order of hybrid mode $(2\pi h/\lambda)^2/4$;

$\lambda$ = wavelength of said electromagnetic energy;

$J_{op}$ = odd mode primary modified Mathieu function;

$J'_{op}$ = first derivative of the odd mode primary modified Mathieu function;

$N_{op}$ = odd mode secondary modified Mathieu function;

$N'_{op}$ = first derivative of the odd mode secondary modified Mathieu function;

$J_{ep}$ = even mode primary modified Mathieu function;

$J'_{ep}$ = first derivative of the even mode primary modified Mathieu function;

$N_{ep}$ = even mode secondary modified Mathieu function; and $N'_{ep}$ = first derivative of the even mode secondary modified Mathieu function, whereby the tangential electric and magnetic field components of said electromagnetic energy in a circumferential direction are zero on said inner ellipse.

2. A waveguide medium as claimed in claim 1, wherein the cross section of said hydbrid mode excitation member is constant over its length, further comprising an elliptical transition member connected to said hybrid mode excitation member, the transition member having a cross section increasing as a function of distance from said excitation member and having longitudinally spaced corrugations of identical configuration to the corrugations of said excitation member.

* * * * *

UNITED STATES PATENT AND TRADEMARK OFFICE

CERTIFICATE OF CORRECTION

PATENT NO. : 4,673,905

DATED : June 16, 1987

INVENTOR(S) : Seiichi Yamawaki et al.

It is certified that error appears in the above-identified patent and that said Letters Patent is hereby corrected as shown below: Title page:

At [73], along with "NEC Corporation, Japan", please add

--and Nippon Hoso Kyokai, Japan--.

Signed and Sealed this

Fourteenth Day of June, 1988

*Attest:*

DONALD J. QUIGG

*Attesting Officer*

*Commissioner of Patents and Trademarks*